US012571224B2

(12) United States Patent
Kawaguchi et al.

(10) Patent No.: US 12,571,224 B2
(45) Date of Patent: Mar. 10, 2026

(54) HOUSE

(71) Applicant: Sekisui House, LTD., Osaka (JP)

(72) Inventors: Noriyuki Kawaguchi, Osaka (JP); Masaru Noma, Osaka (JP); Shinji Tanaka, Osaka (JP); Susumu Urushihara, Osaka (JP)

(73) Assignee: Sekisui House, LTD., Osaka (JP)

( * ) Notice: Subject to any disclaimer, the term of this patent is extended or adjusted under 35 U.S.C. 154(b) by 206 days.

(21) Appl. No.: 18/030,557

(22) PCT Filed: Dec. 2, 2021

(86) PCT No.: PCT/JP2021/044206
§ 371 (c)(1),
(2) Date: Apr. 6, 2023

(87) PCT Pub. No.: WO2022/124181
PCT Pub. Date: Jun. 16, 2022

(65) Prior Publication Data

US 2023/0374803 A1 Nov. 23, 2023

(30) Foreign Application Priority Data

Dec. 11, 2020 (JP) ..... 2020-206260

(51) Int. Cl.
*E04H 1/02* (2006.01)
*F24F 7/08* (2006.01)

(52) U.S. Cl.
CPC ..... *E04H 1/02* (2013.01); *F24F 7/08* (2013.01)

(58) Field of Classification Search
CPC .... F24F 2011/0002; F24F 12/006; F24F 7/00; F24F 7/02; E04H 1/02; E04H 3/08
See application file for complete search history.

(56) References Cited

U.S. PATENT DOCUMENTS 9,518,748 B2 * 12/2016 Holtz ..... C12M 37/00
2004/0147214 A1 * 7/2004 Oono ..... A61L 9/18 454/187

(Continued)

FOREIGN PATENT DOCUMENTS

JP 02-245212 A 10/1990
JP 2002-098381 A 4/2002

(Continued)

OTHER PUBLICATIONS

Aug. 19, 2020, Internet :<URL:http://news-sv.aij.or.jp/kankyo/s7/House_vent_I.pdf> p. 5 lines 30-37, p. 7 lines 5-14, figure 9,16 non-official translation (Infection control by ventilation and draft WG, Measures against virus infection by ventilation in houses, General Incorporated Association Architectural Institute of Japan).

*Primary Examiner* — Paola Agudelo
(74) *Attorney, Agent, or Firm* — Jordan and Koda, PLLC; Steven P. Koda, Esq.

(57) ABSTRACT

A house taking measures against micro-droplet infection. The house includes a corridor, a front chamber leading to the corridor, a habitable room leading to the front chamber, a ventilation system that supplies air from the outside of the house to the habitable room and exhausts air from the front chamber to the outside of the house, and a fan that exhausts air from the habitable room to the outside of the house.

14 Claims, 7 Drawing Sheets

(56) References Cited

U.S. PATENT DOCUMENTS

| | | | | |
|---|---|---|---|---|
| 2008/0313973 | A1* | 12/2008 | Butler Rolf | E04H 3/08 52/741.1 |
| 2012/0083196 | A1* | 4/2012 | Mockridge | H05K 7/20745 454/239 |
| 2013/0171922 | A1* | 7/2013 | Jensen | F24F 7/003 454/239 |
| 2015/0107817 | A1* | 4/2015 | Douglas | F24F 11/62 454/238 |
| 2016/0010883 | A1* | 1/2016 | Jornitz | F24F 3/167 29/897.3 |
| 2016/0128886 | A1* | 5/2016 | Merino | E04H 1/1277 600/21 |
| 2017/0328054 | A1* | 11/2017 | Bakken | E04H 1/005 |
| 2019/0383046 | A1* | 12/2019 | Frey | E04H 3/08 |
| 2020/0256571 | A1* | 8/2020 | Johnson, Jr. | F24F 11/62 |
| 2021/0156582 | A1* | 5/2021 | Stevenson | F24F 7/02 |
| 2021/0197110 | A1* | 7/2021 | Han | B01D 46/442 |
| 2021/0341168 | A1* | 11/2021 | Okeya | F24F 7/08 |

FOREIGN PATENT DOCUMENTS

| | | | |
|---|---|---|---|
| JP | 2020-054791 | A | 4/2020 |
| JP | 2020-159031 | A | 10/2020 |

* cited by examiner

HOUSE

BACKGROUND OF THE INVENTION

The present invention relates to a house in which a mild infectious disease patient (hereinafter also simply referred to as an "infected person") can be cared at home.

A house described in Patent Document 1 has a margin space adjacent to a living dining kitchen (hereinafter also referred to as "LDK"). A sliding door is provided at a boundary portion between the LDK and the margin space. The margin space can be used as a space for isolating an infected person.

PRIOR ART DOCUMENT

Patent Document

Patent Document 1: Japanese Patent Application Laid-Open No. 2020-159031

SUMMARY OF THE INVENTION

As one of infection paths of infectious diseases, micro-droplet infection (also referred to as "aerosol infection") is known. Aerosolized viruses float in a space for a longer time than viruses included in droplets. Thus, future houses are required to have considerations for the micro-droplet infection.

The present invention has been made in view of the above-described circumstances, and an object thereof is to provide a house taking measures against micro-droplet infection.

(1) A house according to the present invention includes a passage, a front chamber leading to the passage, a first habitable room having a first doorway leading to the front chamber, a first door configured to open and close the first doorway, a first ventilation system configured to supply air from an outside of the house to the first habitable room and to exhaust air from the front chamber to the outside of the house, and a first fan configured to exhaust air from the first habitable room to the outside of the house.

According to the above-described configuration, in a case where a resident becomes an infected person, the first habitable room can be used as a home care room. Furthermore, by the first door, the first ventilation system, and the first fan, micro droplets generated in the first habitable room can be suppressed from spreading to the front chamber and a corridor.

(2) The house includes a second habitable room laid out on a same floor as the front chamber and having a second doorway leading to the passage, and a second door configured to open and close the second doorway, and the first ventilation system is configured to further supply air from the outside of the house to the second habitable room.

According to the above-described configuration, by the first door, the second door, the first ventilation system, and the first fan, the micro droplets can be suppressed from spreading from the first habitable room to the second habitable room through the front chamber and the corridor.

(3) The first ventilation system is configured to perform total heat exchange between new air taken from the outside of the house and exhaust air taken from the front chamber, and to supply the new air after the total heat exchange to the first habitable room and the second habitable room.

According to the above-described configuration, both securing of air quality (also referred to as "IAQ") of the first habitable room and the second habitable room and saving energy can be attained.

(4) The house includes a wash and dressing room leading to the passage, and a bathroom leading to the wash and dressing room.

According to the above-described configuration, a line of flow for the infected person to go from the first habitable room to the bathroom and the wash and dressing room can be secured.

(5) The house further includes an entrance, and a changing room leading to the entrance and the wash and dressing room, the changing room having storage furniture for clothes installed.

According to the above-described configuration, since clothes can be changed in the changing room leading to the entrance, viruses can be suppressed from being brought into the wash and dressing room, the first habitable room, and the second habitable room.

(6) The house includes a third habitable room having a third doorway leading to the passage and laid out on a same floor as the wash and dressing room, a third door configured to open and close the third doorway, and a second ventilation system configured to supply air from the outside of the house to the third habitable room and to exhaust air from the changing room to the outside of the house.

According to the above-described configuration, since the second ventilation system exhausts air in the changing room to the outside, the micro droplets can be suppressed from floating in the house.

(7) The second ventilation system is configured to perform total heat exchange between new air taken from the outside of the house and exhaust air taken from the changing room, and to supply the new air after the total heat exchange to the third habitable room.

According to the above-described configuration, both securing of air quality of the third habitable room and saving energy can be attained.

(8) The house includes a third habitable room having a third doorway leading to the passage and laid out on a same floor as the wash and dressing room, a third door configured to open and close the third doorway, and a second fan configured to exhaust air from the changing room to the outside of the house.

According to the above-described configuration, since the second fan exhausts air in the changing room to the outside, the micro droplets can be suppressed from spreading in the house.

(9) The house includes an air cleaner installed in the third habitable room and configured to control an airflow amount in accordance with a number of people in the third habitable room.

According to the above-described configuration, IAQ of the third habitable room can be secured even when the number of people is increased.

According to the present invention, a house taking measures against micro-droplet infection can be provided.

DETAILED DESCRIPTION OF PREFERRED EMBODIMENTS OF THE INVENTION

Hereinafter, an embodiment of the present invention will be described. The following embodiment is merely an example of the present invention, and the embodiment of the present invention can be modified appropriately without changing the gist of the invention.

[Left-Right Direction X, Front-Back Direction Y, and Up-Down Direction Z]

Figure 1:
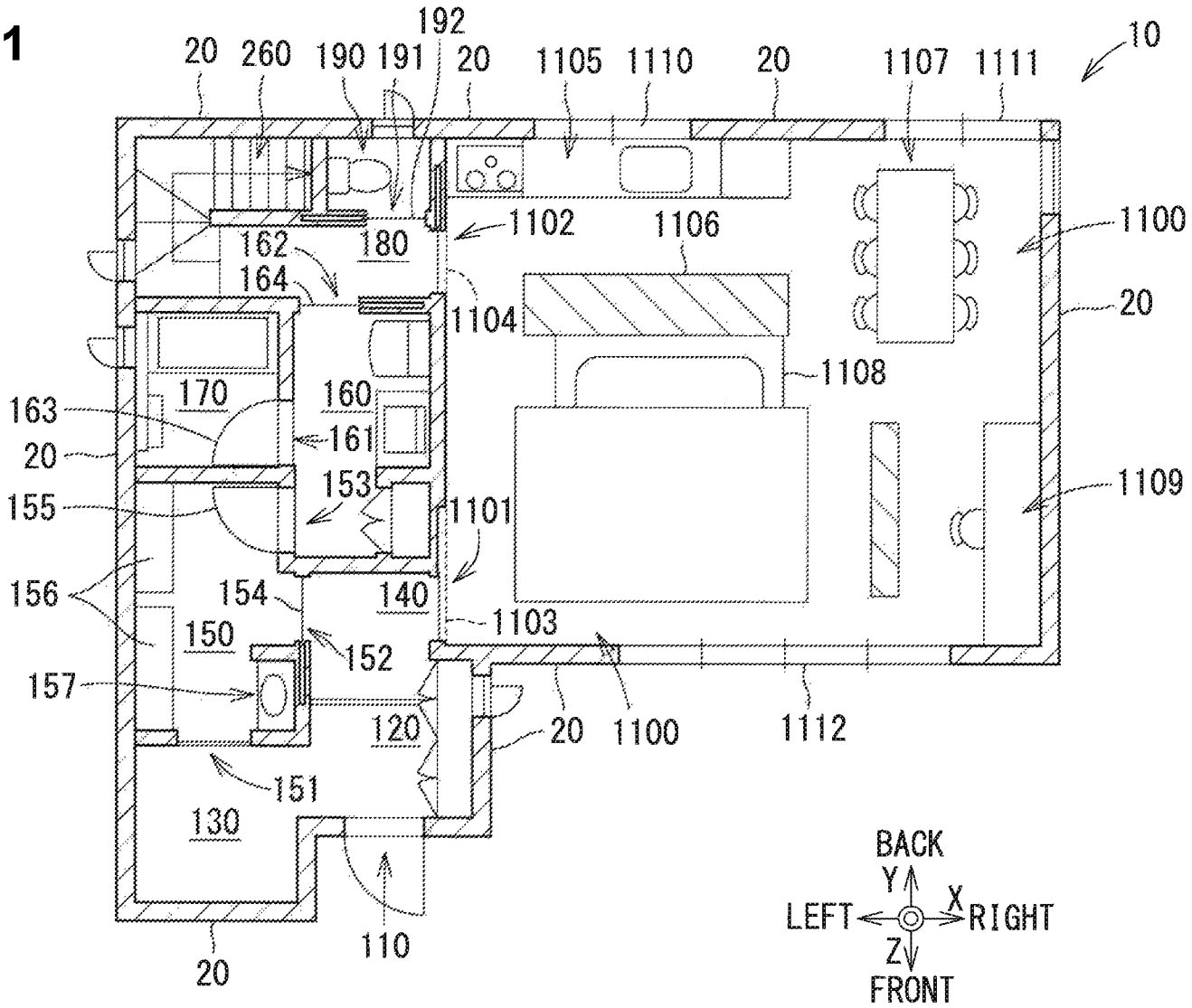
FIG. 1 is a plan view showing a floor plan of the first floor of a house 10.

In FIG. 1 and the like, arrows X, Y, and Z perpendicularly intersecting with each other are shown. The arrows X, Y, and Z respectively indicate a left-right direction X, a front-back direction Y, and an up-down direction Z. The left-right direction X is defined based on a state in which a person directly faces a doorway 110 of a house 10 (see FIG. 1) from the outside of the house 10. As for the front-back direction Y, a doorway 110 side of the house 10 is taken as a front side, and the opposite side is taken as a back side. In the up-down direction Z, an upward direction and a downward direction are the same as the vertically upward direction and the vertically downward direction, respectively.

[Configuration of House 10]

Figure 2:
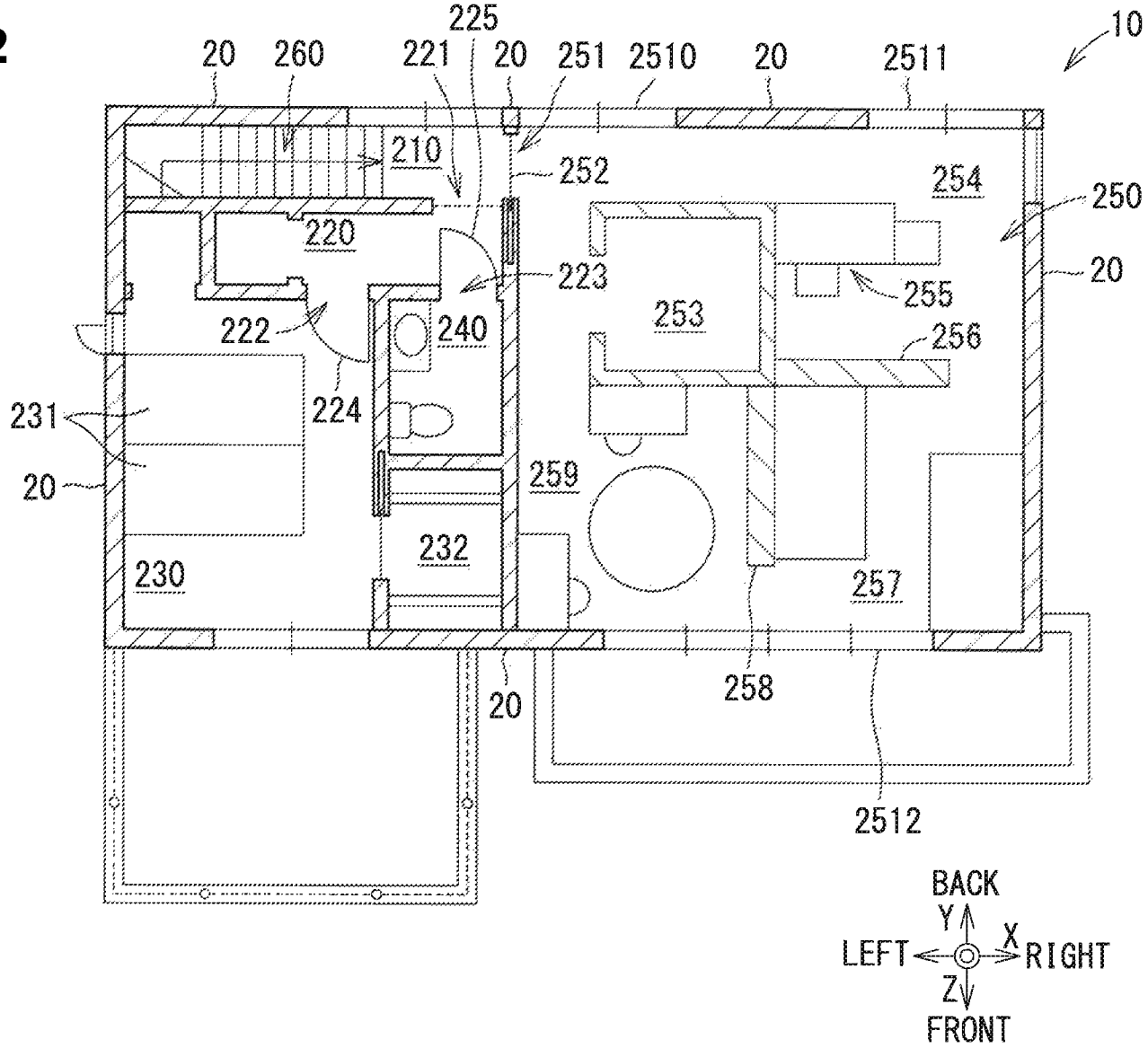
FIG. 2 is a plan view showing a floor plan of the second floor of the house 10.

In FIGS. 1 and 2, the house 10 has two stories and includes an outer wall 20.

[Detailed Configuration of First Floor of House 10]

In FIG. 1, the house 10 includes, on the first floor, the doorway 110, an entrance 120, a shoe cloak (hereinafter also referred to as "SC") 130, a hall 140, a changing room (hereinafter also referred to as "CR") 150, awash and dressing room 160, a bathroom 170, a corridor 180, a toilet room 190, and a habitable room 1100.

[Entrance 120, SC 130, and Hall 140]

The entrance 120 is laid out near the left end and at the front end on the first floor. The doorway 110 is provided at a portion defining the entrance 120 in the outer wall 20.

The SC 130 is laid out at the front-left corner of the first floor. The SC 130 is in the left neighbor of the entrance 120 and communicates with the entrance 120, and is in the front neighbor of the CR 150 and communicates with the CR 150 via a doorway 151. Storage furniture for shoes is installed in the SC 130. A person moves forth and back between the SC 130 and the entrance 120, with wearing shoes. The person moves from the SC 130 to the CR 150 after taking off the shoes in the SC 130, and wears the shoes in the SC 130 after moving from the CR 150 to the SC 130.

A plurality of earth floor tiles is stuck to the entrance 120 and the SC 130. Each earth floor tile may be an antiviral earth floor tile.

The hall 140 is laid out in the back neighbor of the entrance 120 and communicates with the entrance 120. A person moves from the entrance 120 to the hall 140 after taking off the shoes in the entrance 120.

A plurality of floorboards is stuck to the hall 140. Each floorboard may have an antiviral property. Regarding this point, the same holds true for floorboards in other rooms.

[CR (Changing Room) 150]

The CR 150 is laid out at the left end of the first floor and in the left neighbor of the entrance 120, the hall 140, and the wash and dressing room 160. The CR 150 is laid out in the back neighbor of the SC 130 and in the front neighbor of the bathroom 170. The CR 150 is defined by the outer wall 20 and an inner wall. Antiviral cloth may be stuck to the inner wall. Regarding this point, the same holds true for other inner walls.

The CR 150 respectively communicates with the SC 130, the hall 140, and the wash and dressing room 160 through doorways 151, 152, 153 formed on the inner wall. In the present embodiment, the doorway 151 is not provided with a door. The doorways 152, 153 are respectively provided with a sliding door 154 and a hinged door 155. The sliding door 154 and the hinged door 155 each have an undercut for ventilation. A plurality of floorboards is stuck to the CR 150. A handhold of the sliding door 154 and a handle of the hinged door 155 may be an antiviral handhold and handle.

Note that other sliding doors and hinged doors may also have undercuts. Furthermore, regarding the antiviral property, the same holds true for handholds of the other sliding doors and handles of the other hinged doors. Furthermore, the sliding door 154 may be a hinged door, or the hinged door 155 may be a sliding door. Similarly, the other hinged doors may be sliding doors, or the other sliding doors may be hinged doors.

Storage furniture 156 for clothes is installed along the outer wall 20 in the CR 150. A person changes clothes in the CR 150.

[Wash and Dressing Room 160]

The wash and dressing room 160 is laid out in the right neighbor of the CR 150 and the bathroom 170 and in the left neighbor of the habitable room 1100 on the first floor. The wash and dressing room 160 is laid out in the back neighbor of the hall 140 and in the front neighbor of the corridor 180. The wash and dressing room 160 is defined by an inner wall. The wash and dressing room 160 respectively communicates with the bathroom 170 and the corridor 180 through doorways 161, 162 formed on the inner wall. The doorways 161, 162 are respectively provided with a hinged door 163 and a sliding door 164. A washstand and the like are installed along the inner wall in the wash and dressing room 160.

[Bathroom 170]

The bathroom 170 is laid out at the left end and in the left neighbor of the wash and dressing room 160 on the first floor. The bathroom 170 is laid out in the back neighbor of the CR 150 and in the front neighbor of the corridor 180 and stairs 260. The bathroom 170 is defined by the outer wall 20 and an inner wall. A bathtub and the like are installed in the bathroom 170.

[Corridor 180]

The corridor 180 is laid out at a position in the back neighbor of the wash and dressing room 160 and the bathroom 170 and in the front neighbor of the toilet room 190. At this position, the corridor 180 extends in the left-right direction X between a doorway 1102 of the habitable room 1100 and the lower end of the stairs 260. A plurality of floor materials is stuck to the corridor 180.

[Toilet Room 190]

The toilet room 190 is laid out at the back end and in the back neighbor of the corridor 180 on the first floor. The toilet room 190 is laid out in the left neighbor of the habitable room 1100 and in the right neighbor of the stairs 260. The toilet room 190 is defined by the outer wall 20 and an inner wall. The toilet room 190 communicates with the corridor 180 through a doorway 191 formed on the inner wall. The doorway 191 is provided with a hinged door 192. Floor materials are stuck to the toilet room 190, and a toilet bowl is installed.

[Habitable Room 1100]

The habitable room 1100 occupies most area of the first floor, and is laid out in the right neighbor of the hall 140, the wash and dressing room 160, the corridor 180, and the toilet room 190. The habitable room 1100 is defined by the outer wall 20 and an inner wall. The habitable room 1100 respectively communicates with the hall 140 and the corridor 180 through doorways 1101, 1102 formed on the inner wall. The doorways 1101, 1102 are respectively provided with sliding doors 1103, 1104. The sliding doors 1103, 1104 are automatic doors to prevent contact infection. Furthermore, floor materials are stuck to the habitable room 1100.

Note that the habitable room 1100 is an example of a third habitable room. The doorway 1102 is an example of a third doorway. The sliding door 1104 is an example of a third door. Furthermore, the sliding doors 1103, 1104 may not necessarily be automatic doors.

The habitable room 1100 is an LDK. The back-left portion of the habitable room 1100 is used as a kitchen. A sink 1105 and the like are installed along the outer wall 20 in the kitchen. Furthermore, a counter 1106 is installed at a position apart from the sink 1105 in the front direction. The back-right portion of the habitable room 1100 is used as a dining room. A dining set 1107 can be laid out in the dining room. Most portion of the front side of the habitable room 1100 is used as a living room. A sofa 1108 and the like are laid out in the living room. One corner in the front-right corner of the habitable room 1100 can be used as a free space. A desk 1109 and the like can be laid out in the free space.

Figure 3A:
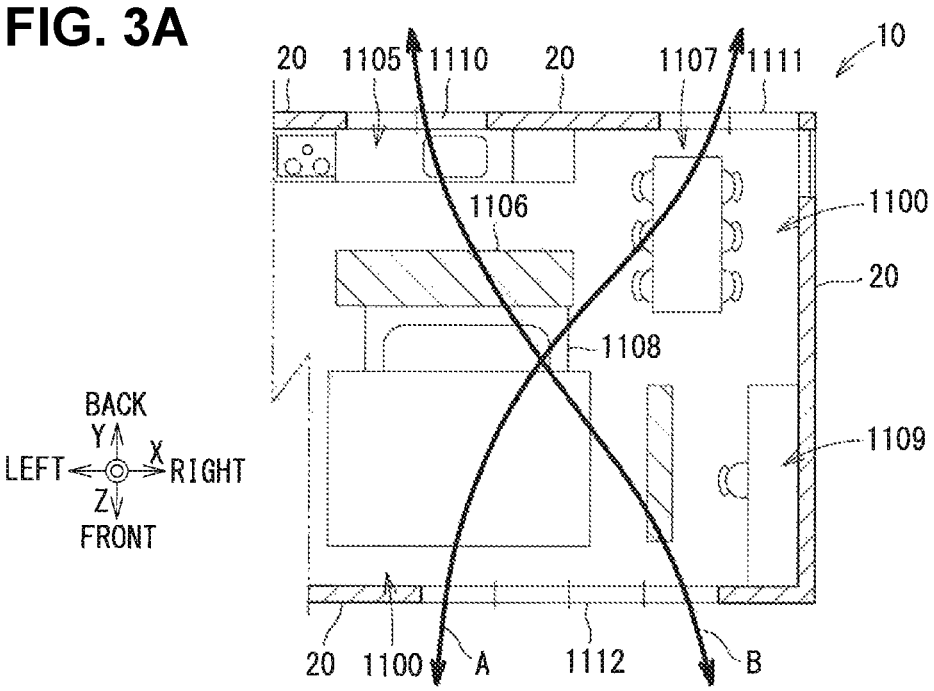
FIG. 3A and FIG. 3B are schematic diagrams showing airflows generated in habitable rooms 1100, 250, respectively.

The habitable room 1100 has a generally rectangular shape in plan view, includes two windows 1110, 1111 on the outer wall 20 on the back side, and includes a terrace-type window 1112 on the outer wall 20 on the front side. The windows 1110 to 1112 are all double sliding windows. The windows 1110, 1111 are respectively attached near the left end and near the right end of the habitable room 1100 so as to be apart from each other. As shown in FIG. 3A, by opening the window 1110 and the right side of the window 1112, since air flows between opposite angles of the habitable room 1100 as shown by the arrow A, air is hard to stagnate in the habitable room 1100. In order to avoid blocking such airflow, low-height fittings and furniture are laid out in the habitable room 1100. In a case where the window 1111 and the left side of the window 1112 are opened, air flows between opposite angles of the habitable room 1100 as shown by the arrow B.

[Stairs 260]

In FIGS. 1 and 2, the house 10 includes the stairs 260 connecting the corridor 180 on the first floor and a corridor 210 on the second floor. Specifically, the stairs 260 extend upward from the left end of the corridor 180 with bending along a portion of the back-left corner of the outer wall 20 to the left end of the corridor 210.

[Detailed Description of Second Floor of House 10]

In FIG. 2, the house 10 includes, on the second floor, the corridor 210, a front chamber 220, a habitable room 230, a toilet room 240, and a habitable room 250. The habitable room 230 is an example of a first habitable room. The habitable room 250 is an example of a second habitable room.

[Corridor 210]

The corridor 210 extends from the right end of the stairs 260 along the outer wall 20 in the left-right direction X to a doorway 251 of the habitable room 250. A plurality of floor materials is stuck to the corridor 210.

[Front Chamber 220]

The front chamber 220 is laid out in the front neighbor of the stairs 260 and the corridor 210 and in the back neighbor of the habitable room 230 and the toilet room 240. The front chamber 220 is laid out in the left neighbor of the habitable room 250. The front chamber 220 is defined by an inner wall, in four directions. The front chamber 220 respectively communicates with the corridor 210, the habitable room 230, and the toilet room 240 through doorways 221, 222, 223 formed on the inner wall. The doorways 222, 223 are respectively provided with hinged doors 224, 225. A plurality of floor materials is stuck to the front chamber 220. The doorway 222 is an example of a first doorway. The hinged door 224 is an example of a first door.

In the present embodiment, when an infected person occurs in inhabitants, the habitable room 230 is used as a home care room. The front chamber 220 is provided between the doorway 221 and the corridor 210 so that viruses aerosolized in the habitable room 230 is hard to float and move to the corridor 210 and the habitable room 250. The volume of the front chamber 220 is smaller than the volume of the habitable room 230.

[Habitable Room 230]

The habitable room 230 occupies approximately the left half of the second floor, and is laid out in the front neighbor of the front chamber 220 and in the left neighbor of the toilet room 240 and the habitable room 250. The habitable room 230 is defined by the outer wall 20 and an inner wall. A plurality of floor materials is stuck to the habitable room 230. A plurality of beds 231 can be installed in the habitable room 230. Furthermore, a walk-in closet 232 is provided at the front-right corner of the habitable room 230. The habitable room 230 is used as a bedroom when no infected person occurs (that is, in normal time).

[Toilet Room 240]

The toilet room 240 is laid out in the front neighbor of the front chamber 220 and in the back neighbor of the walk-in closet 232. The toilet room 240 is laid out in the right neighbor of the habitable room 230 and in the left neighbor of the habitable room 250. A toilet bowl and a washstand are installed in the toilet room 240.

[Habitable Room 250]

The habitable room 250 occupies most area of the second floor, and is laid out in the right neighbor of the corridor 210, the front chamber 220, the toilet room 240, and the walk-in closet 232. The habitable room 250 is defined by the outer wall 20 and an inner wall. The habitable room 250 communicates with the corridor 210 through the doorway 251 formed on the inner wall. The doorway 251 is provided with a sliding door 252. The habitable room 250 is an example of a second habitable room. The doorway 251 is an example of a second doorway. The sliding door 252 is an example of a second door.

Figure 3B:
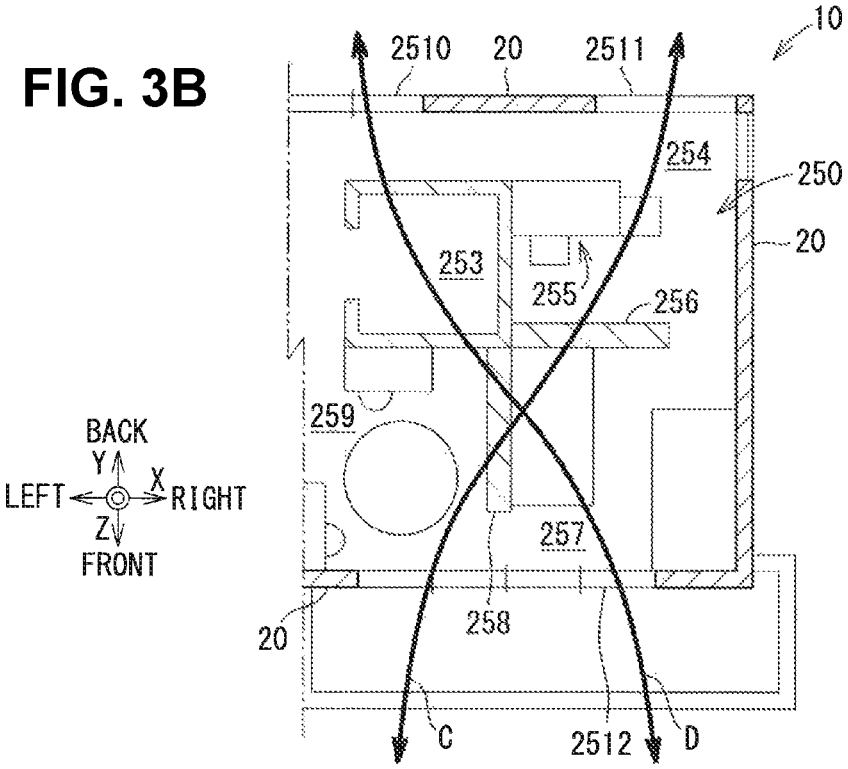

The habitable room 250 has a generally rectangular shape in plan view, two windows 2510, 2511 are attached to the outer wall 20 on the back side, and a terrace-type window 2512 is attached to the outer wall 20 on the front side. The windows 2510 to 2512 are all sliding windows. The windows 2510, 2511 are attached near the left end and near the right end of the habitable room 250 so as to be apart from each other. With this, as with the case of the habitable room 1100, airflows (see arrows C and D in FIG. 3B) can be generated between opposite angles of the habitable room 250. In order to generate these airflows, each height of the walk-in closet 253 and the partitions 256, 258 is sufficiently lower than that of the ceiling of the habitable room 250.

The habitable room 250 has a generally rectangular shape in plan view, two windows 2510, 2511 are attached to the outer wall 20 on the back side, and a terrace-type window 2512 is attached to the outer wall 20 on the front side. The windows 2510 to 2512 are all sliding windows. The windows 2510, 2511 are attached near the left end and near the right end of the habitable room 250 so as to be apart from each other. With this, as with the case of the habitable room 1100, airflows (see arrows C and D in FIG. 3 (B)) can be generated between opposite angles of the habitable room 250. In order to generate these airflows, each height of the walk-in closet 253 and the partitions 256, 258 is sufficiently lower than that of the ceiling of the habitable room 250.

[Ventilation System 30]

Figure 4:
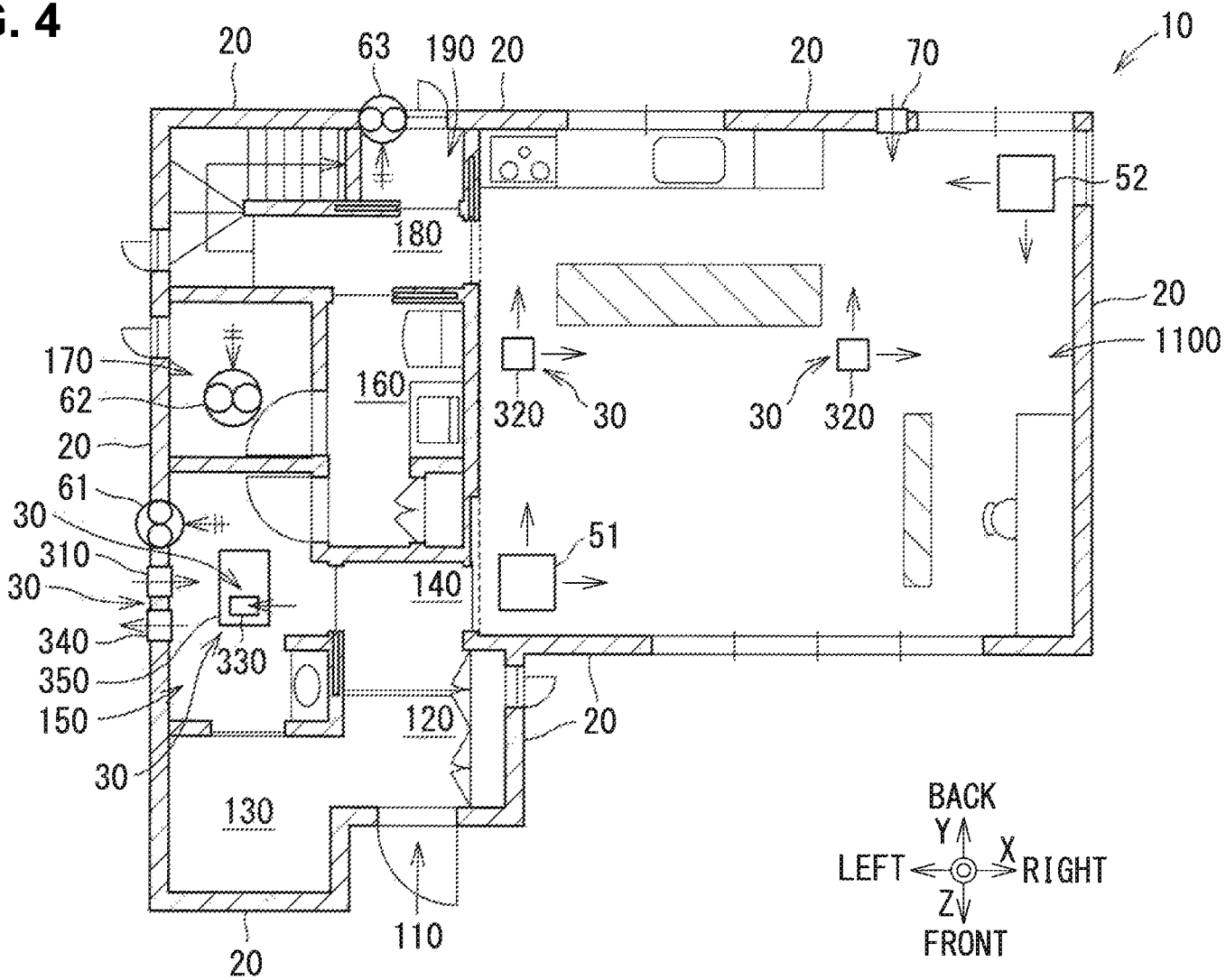
FIG. 4 is a schematic diagram showing a layout of a ventilation system 30 and the like on the first floor.

As shown in FIG. 4, the house 10 includes a ventilation system 30 on the first floor. The ventilation system 30 is an example of a second ventilation system. The ventilation system 30 includes a new air suction port 310, a plurality of air supply ports 320, an exhaust air suction port 330, an air exhaust port 340, a ventilation unit 350, and a plurality of ducts 361 to 364 (see FIG. 5). Note that the number of the air supply ports 320 is two in the ventilation system 30.

[New Air Suction Port 310, Air Supply Ports 320, Exhaust Air Suction Port 330, and Air Exhaust Port 340]

The new air suction port 310 is attached to the outer wall 20. Outer air of the house 10 is suctioned through the new air suction port 310 as new air.

The air supply ports 320 are attached at different positions on the ceiling of the habitable room 1100. Each air supply port 320 has an opening opened toward the inside of the habitable room 1100.

The exhaust air suction port 330 is attached to the ceiling of the CR 150 and has an opening opened toward the inside of the CR 150. Air in the CR 150 is suctioned through the exhaust air suction port 330 as exhaust air.

The air exhaust port 340 is provided on the outer wall 20, and has an opening opened to the outside of the house 10.

[Ventilation Unit 350, and Ducts 361 to 364]

Figure 5:
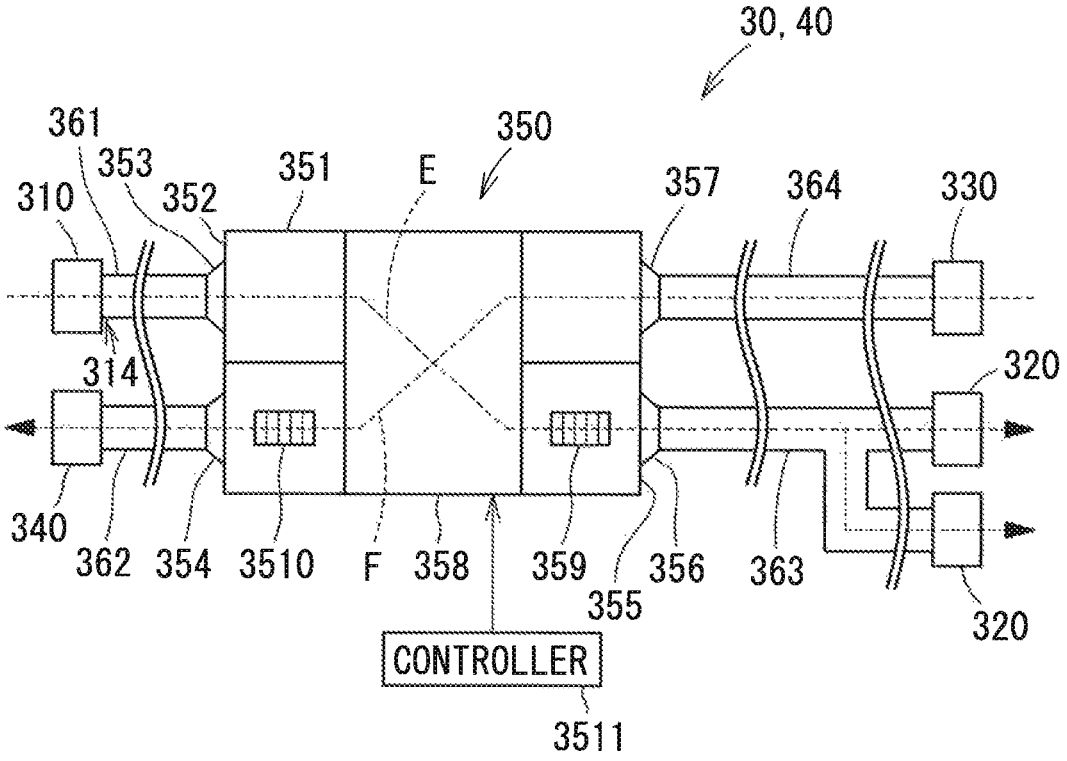
FIG. 5 is a schematic diagram showing an overall configuration of ventilation systems 30, 40.

The ventilation unit 350 is provided in the ceiling of the first floor and has a generally rectangular parallelepiped-shaped housing 351 as shown in FIG. 5. The housing 351 has a new air suction port 353 and an exhaust air outlet 354 on one side surface 352, and has a new air outlet 356 and an exhaust air suction port 357 on a side surface 355 opposing to the side surface 352.

The ducts 361 to 364 are provided in the ceiling of the first floor. The duct 361 is connected to the new air suction port 353 at one end and is connected to the new air suction port 310 at the other end. The duct 362 is connected to the exhaust air outlet 354 at one end and is connected to the air exhaust port 340 at the other end. The duct 363 is connected to the new air outlet 356 at one end and is connected to each of the air supply ports 320 at the other ends. The duct 364 is connected to the exhaust air suction port 357 at one end and is connected to the exhaust air suction port 330 at the other end.

The ventilation unit 350 further includes a total heat exchange element 358, an air supply fan 359, an air exhaust fan 3510, and a controller 3511 in the housing 351. Furthermore, a new air flow path E and an exhaust air flow path F are formed in the housing 351.

The new air flow path E leads from the new air suction port 353 to the new air outlet 356 via the total heat exchange element 358. The exhaust air flow path F leads from the exhaust air suction port 357 to the exhaust air outlet 354 via the total heat exchange element 358.

The air supply fan 359 is located between the total heat exchange element 358 and the new air outlet 356 on the new air flow path E. The air supply fan 359 rotates under the control by the controller 3511, and generates, on the new air flow path E, an airflow flowing from the new air suction port 353 to the new air outlet 356.

The air exhaust fan 3510 is located between the total heat exchange element 358 and the exhaust air outlet 354 on the exhaust air flow path F. The air exhaust fan 3510 rotates under the control by the controller 3511, and generates, on the exhaust air flow path F, an airflow flowing from the exhaust air suction port 357 to the exhaust air outlet 354.

The total heat exchange element 358 performs total heat exchange between the new air flowing from the new air suction port 353 through the new air flow path E and the exhaust air flowing from the exhaust air suction port 357 through the exhaust air flow path F.

The controller 3511 makes each of the air supply fan 359 and the air exhaust fan 3510 rotate so as to blow air at an airflow amount in accordance with a ventilation condition (one of "weak", "normal", "continuous", for example) set by a user's operation.

[Ventilation System 40]

Figure 6:
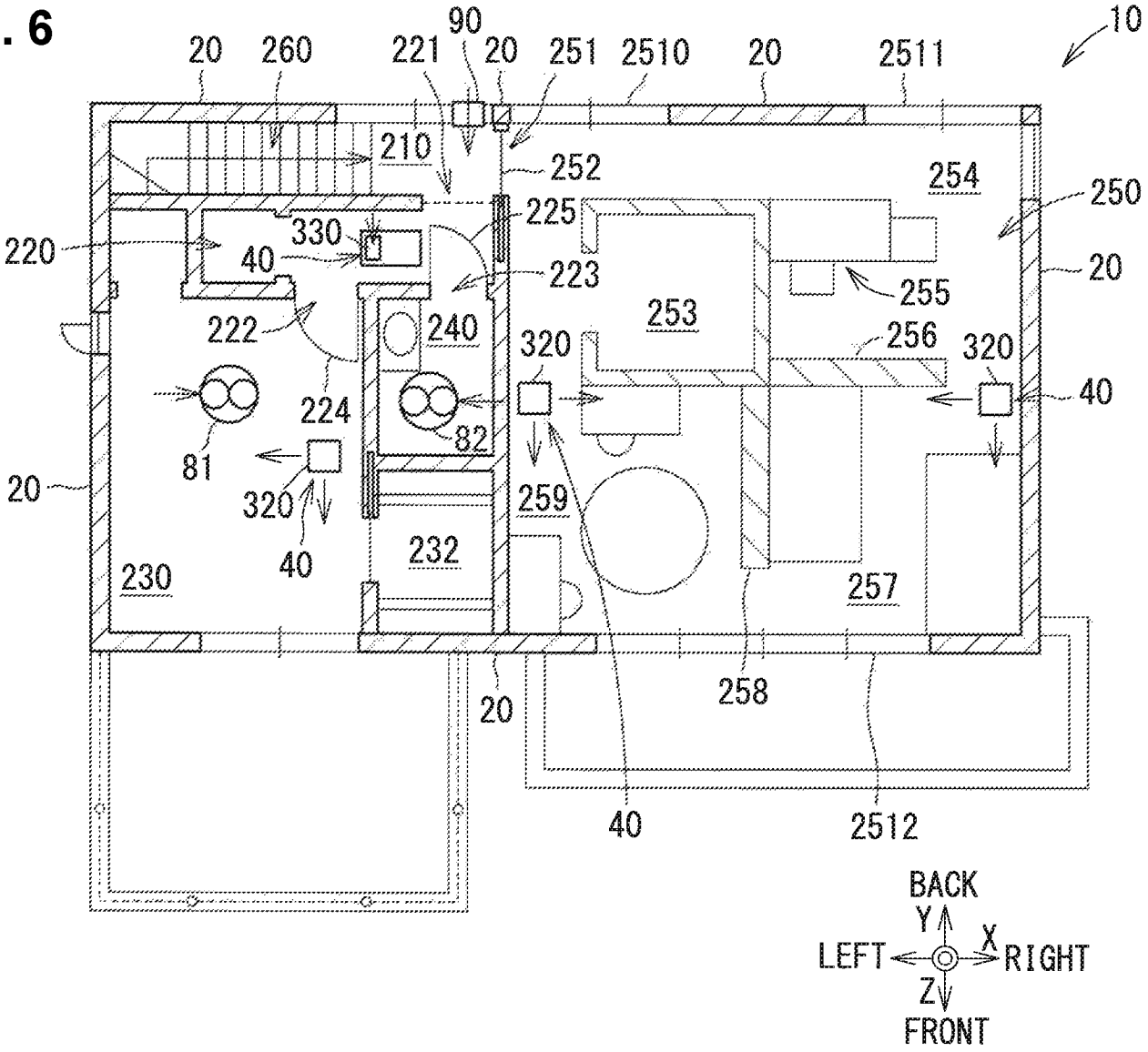
FIG. 6 is a schematic diagram showing a layout of the ventilation system 40 and the like on the second floor.

As shown in FIG. 6, the house 10 includes a ventilation system 40 on the second floor. The ventilation system 40 is an example of a first ventilation system. The ventilation system 40 has a configuration similar to that of the ventilation system 30. Thus, in the ventilation system 40, same reference characters are assigned to configurations similar to those of the ventilation system 30. Furthermore, in the following, the ventilation system 40 will be described mainly with respect to differences from the ventilation system 30.

In the ventilation system 40, the number of the air supply ports 320 is three. Two of the three air supply ports 320 are attached at different positions on the ceiling of the habitable room 250. The remaining one air supply port 320 is attached to the ceiling of the habitable room 230.

The exhaust air suction port 330 is attached to the ceiling of the front chamber 220.

The ventilation unit 350 and the ducts 361 to 364 are provided in the ceiling of the second floor.

[Operations of Ventilation Systems 30, 40]

Each of the ventilation systems 30, 40 suctions outer air of the house 10 as new air through the new air suction port 310 by the rotation of the air supply fan 359, and guides the new air to the ventilation unit 350 by the duct 361. Each of the ventilation systems 30, 40 suctions air in the CR 150 or the front chamber 220 through the exhaust air suction port 330 as exhaust air by the rotation of the air exhaust fan 3510, and guides the exhaust air to the ventilation unit 350 by the duct 364.

Each of the ventilation systems 30, 40 performs total heat exchange between the new air and the exhaust air by the total heat exchange element 358 of the ventilation unit 350. The ventilation system 30 supplies the new air after the total heat exchange from the new air outlet 356 through the duct 363 and from the air supply port 320 to the habitable room 1100. The ventilation system 40 supplies the new air after the total heat exchange from the new air outlet 356 through the duct 363 and from the air supply ports 320 to the habitable rooms 230, 250. Each of the ventilation systems 30, 40 exhausts the exhaust air after the total heat exchange from the exhaust air outlet 354 through the duct 362 and from the air exhaust port 340 to the outside of the house 10.

[Air Cleaners 51, 52]

As shown in FIG. 4, the house 10 further includes air cleaners 51, 52. Each of the air cleaners 51, 52 is a ceiling-embedded type air cleaner. The air cleaner 51 is provided at the front-left corner on the ceiling of the habitable room 1100. The air cleaner 52 is provided at the back-right corner on the ceiling of the habitable room 1100.

Each of the air cleaners 51, 52 operates under the control of a controller (not shown). Specifically, the air cleaners 51, 52 suction air in the habitable room 1100 by an internal fan. The air cleaners 51, 52 filter the suctioned air with an internal suction filter. The air cleaners 51, 52 blow the filtered air to the habitable room 1100.

The air cleaners 51, 52 have a human sensor. The controller derives the number of people in the habitable room 1100 based on output signals of the human sensors. The controller can control the amount of rotation of the fans so that as the number of people in the habitable room 1100 becomes larger, the airflow amounts of the fans become larger.

Note that the air cleaners 51, 52 may have a house dust sensor in place of the human sensor. The house dust sensor outputs, to the controller, a signal that correlates to the amount of house dust (that is, fine particles). The controller derives the amount of the house dust based on output signals of the house dust sensors. The controller may be capable of controlling the amount of rotation of the fans so that as the amount of the house dust in the habitable room 1100 becomes larger, the airflow amounts of the fans become larger. Since the amount of the house dust correlates to the number of people in the habitable room 1100, the controller of the air cleaners 51, 52 controls so as to increase the airflow amounts of the fans in accordance with the number of people in the habitable room 1100, also when based on the output signals of the house dust sensors.

[Various Fans, and Various Air Supply Ports]

As shown in FIG. 4, the house 10 further includes fans 61 to 63 and an air supply port 70 on the first floor.

The fan 61 is installed on the outer wall 20 of the CR 150. The fan 61 is an example of a second fan. The fan 61 exhausts air in the CR 150 to the outside of the house 10 by rotating according to a ventilation condition (one of "weak", "normal", and "continuous", for example) set by a user. In the present embodiment, both the exhaust air suction port 330 and the fan 61 are attached to the CR 150. However, not limited thereto, in a case where the exhaust air suction port 330 is provided on the ceiling of the CR 150, the fan 61 may not necessarily be attached to the outer wall 20 of the CR 150. Furthermore, in a case where the exhaust air suction port 330 is provided at a place other than the CR 150, the fan 61 may be attached to the outer wall 20 of the CR 150.

The fan 62 is a ceiling-embedded type ventilation fan and is installed on the ceiling of the bathroom 170. The fan 62 exhausts air in the bathroom 170 to the outside of the house 10 via a duct (not shown) by rotating according to the ventilation condition set by the user.

The fan 63 is installed on the outer wall 20 of the toilet room 190. The fan 63 exhausts air in the toilet room 190 to the outside of the house 10 by rotating according to the ventilation condition set by the user.

The air supply port 70 is provided on the outer wall 20 on the back side in the habitable room 1100.

As shown in FIG. 6, the house 10 further includes fans 81, 82 and an air supply port 90 on the first floor. The fan 81 is an example of a first fan.

The fans 81, 82 are ceiling-embedded type ventilation fans. The fan 81 is installed on the ceiling of the habitable room 230. The fan 81 exhausts air in the habitable room 230 to the outside of the house 10 through a duct (not shown) by rotating. The fan 82 exhausts air in the toilet room 240 to the outside of the house 10 via a duct (not shown) by rotating.

The air supply port 90 is provided on the outer wall 20 on the back side in the corridor 210.

[Ventilation Amount of Ventilation System 40, and Ventilation Amount of Fan 81]

Figure 7A:
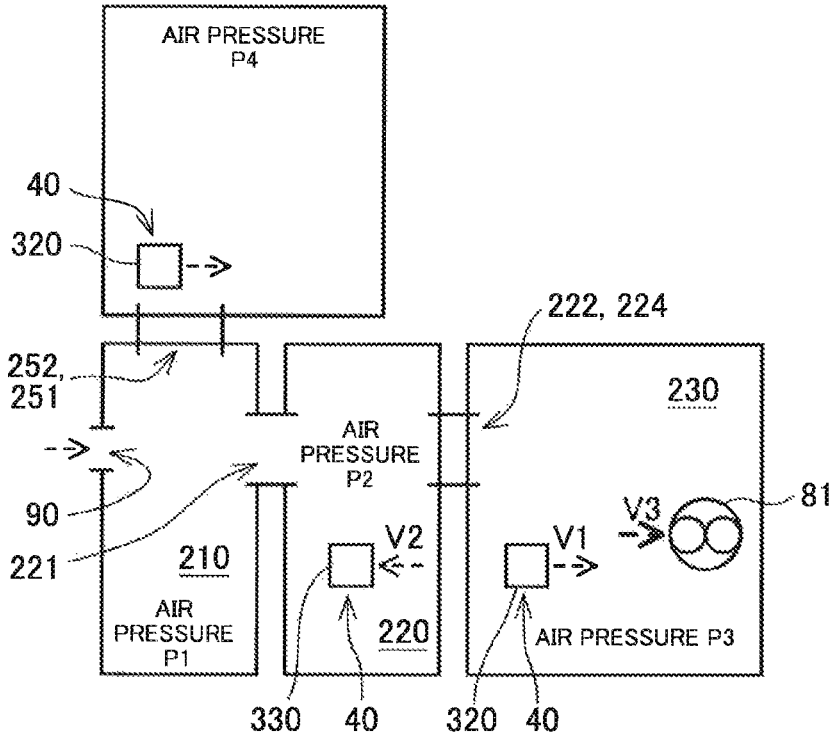
FIG. 7A is a schematic diagram showing relationships among air pressures P1 to P4 on the second floor during continuous operations of the ventilation system 40 and a fan 81.

During a continuous operation of the ventilation system 40, an airflow amount per unit time of new air supplied from the air supply port 320 to the habitable room 230 is supposed to be V1 (see FIG. 7A). Furthermore, during the continuous operation of the ventilation system 40, an airflow amount per unit time of exhaust air suctioned from the exhaust air suction port 330 is supposed to be V2 (see FIG. 7A). Furthermore, during the continuous operation of the fan 81, supposing an airflow amount per unit time of air exhausted to the outside of the habitable room 230 to be V3 (see 7A), V1, V2, and V3 satisfy $V3>V1$ . . . (1) and satisfy $V3-V1>V2$ . . . (2).

[Ventilation and the Like of House 10 in Normal Time]

In the normal time, when only a small number of people (for example, four family members) are in the house 10, each of the ventilation systems 30, 40 performs ventilation according to the ventilation condition set by the user. The fans 61 to 63, 81, 82 exhaust air according to the ventilation condition set by the user. Note that in accordance with the exhaust air by the fans 61 to 63, new air is taken from the air supply port 70 into the first-floor portion of the house 10. Furthermore, in accordance with the exhaust air by the fans 81, 82, new air is taken from the air supply port 90 into the second-floor portion of the house 10. In the normal time, the ventilation system 40 and the fan 81 may simultaneously ventilate by the user's operation, but may not necessarily ventilate simultaneously. Under the control of a controller (not shown), each of the air cleaners 51, 52 filters and blows out air suctioned from the habitable room 1100.

When the number of people in the habitable room 1100 is increased as compared to the normal time, the ventilation system 30 and the fans 61 to 63 exhaust air according to the set ventilation condition, similarly to the normal time. Each of the air cleaners 51, 52 filters and blows out the air suctioned from the habitable room 1100 by rotating the internal fan with an airflow amount in accordance with the number of people in the habitable room 1100.

[Ventilation and the Like of House 10 when Infected Person Occurs]

When an infected person occurs, the habitable room 230 on the second floor is used as a home care room for the infected person. While the infected person is cared at home, each of the ventilation systems 30, 40 and the fan 81 perform continuous operations according to the user's operation. Furthermore, except when needed, the hinged door 224 of the front chamber 220 is maintained in a closed state.

[Actions and Effects of House 10]

During the home care of the infected person, the ventilation system 40 and the fan 81 perform the continuous operations. The hinged door 224 of the front chamber 220 is essentially kept in the closed state. Furthermore, the airflow amounts V1, V2, and V3 are as previously described with reference to FIG. 7A and satisfy the formulae (1) and (2). With this, in the second floor of the house 10, the air pressure P1 in the corridor 210, the air pressure P2 in the front chamber 220, and the air pressure P3 in the habitable room 230 satisfy P3<P2<P1. As a result, micro droplets generated in the habitable room 230 can be suppressed from spreading from the habitable room 230 to the front chamber 220 and the corridor 210.

Furthermore, during the home care, the ventilation system 40 supplies air from the two air supply ports 320 to the habitable room 250. Furthermore, the sliding door 252 is provided at the doorway 251 leading to the corridor 210 in the habitable room 250. Thus, it becomes easier for the air pressure P4 (see FIG. 7A) in the habitable room 250 to be higher than the air pressure P1 of the corridor 210. With this, the micro droplets generated in the habitable room 230 can be suppressed from spreading to the habitable room 250 via the front chamber 220 and the corridor 210.

Since the total heat exchange is performed in the ventilation systems 30, 40, both securing of IAQ of the habitable rooms 1100, 230, 250 and saving energy can be attained.

On the second floor of the house 10, the habitable room 230 leads to a passage consisting of the corridor 180, the stairs 260, and the corridor 210, via the front chamber 220. The wash and dressing room 160 leads to the passage on the first floor. Furthermore, the bathroom 170 leads to the passage via the wash and dressing room 160. Thus, a line of flow of for the infected person cared in the habitable room 230 to go to the wash and dressing room 160 and the bathroom 170 can be secured.

The CR 150 communicates with the entrance 120 through the SC 130 and communicates with the wash and dressing room 160. By laying out the CR 150 near the entrance 120 in the line of flow of the house 10, a person can change clothes before moving from the entrance 120 to the habitable rooms 1100, 230, 250. Furthermore, in the CR 150, a hand wash basin 157 is installed along the inner wall. With this, a person can wash hands and gargle before moving from the entrance 120 to the habitable room 1100 or the like. By the CR 150 and the hand wash basin 157, a person can be suppressed from moving to the wash and dressing room 160, the habitable room 1100, or the like in a state where viruses are attached to the person.

Figure 7B:
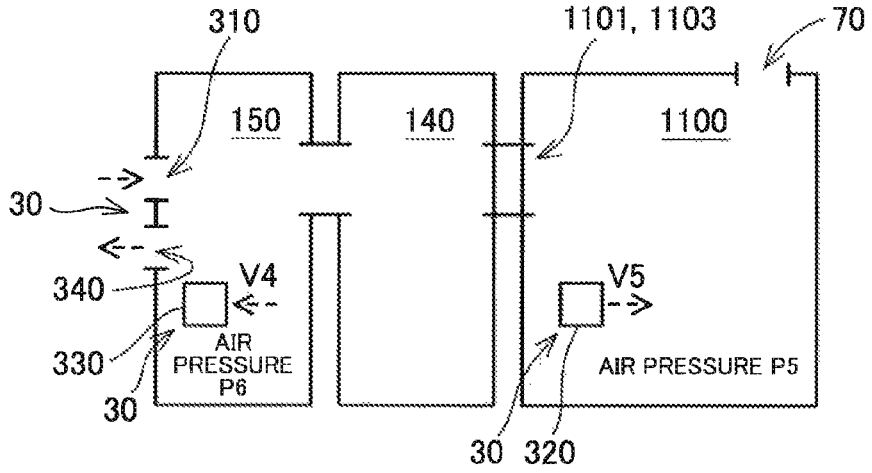
FIG. 7B is a schematic diagram showing a relationship between air pressures P5, P6 on the first floor during a continuous operation of the ventilation system 30.

The ventilation system 30 exhausts air from the CR 150 to the outside of the house 10. Thus, the viruses can be suppressed from spreading from the CR 150 to the house 10. The ventilation system 30 supplies air from the outside of the house 10 to the habitable room 1100. The habitable room 1100 has the sliding doors 1103, 1104. Here, as shown in FIG. 7B, during the continuous operation of the ventilation system 30, an airflow amount per unit time of new air supplied from the air supply port 320 to the habitable room 1100 is supposed to be V5, and an airflow amount per unit time of exhaust air suctioned from the exhaust air suction port 330 is supposed to be V6. Note that the magnitude relationship between V5 and V6 is not particularly limited. By providing the air supply port 320 to the habitable room 1100 and providing the exhaust air suction port 330 to the CR 150 in this manner, it becomes easy for the air pressure P5 in the habitable room 1100 to be higher than the air pressure P6 in the CR 150. Thus, even when the infected person uses the wash and dressing room 160, the micro droplets can be suppressed from spreading to the habitable room 1100. Note that even in a case where the exhaust air suction port 330 is not provided to the CR 150, instead the fan 61 is attached to the outer wall 20 of the CR 150, similar effects can be attained.

By installing the air cleaners 51, 52, IAQ of the habitable room 1100 can be secured even when the number of people in the habitable room 1100 is increased.

Modification Examples

In the embodiment, the ventilation systems 30, 40 are total heat exchange ventilation systems. However, not limited thereto, the ventilation systems 30, 40 may not necessarily perform the total heat exchange.

In the embodiment, the ventilation systems 30, 40 and various fans are provided to the house 10 as measures against the micro-droplet infection. However, the ventilation systems 30, 40 and the various fans also serve as measures against contaminants such as pollens or house dust.

In the embodiment, during the home care of the infected person, the micro droplets generated in the habitable room 230 can be suppressed from spreading from the habitable room 230 to the front chamber 220 and the corridor 210, because the ventilation system 40 and the fan 81 perform the continuous operations. However, not limited thereto, in a case where the exhaust air suction port 330 of the ventilation system 40 is not provided on the ceiling of the front chamber 220, the micro droplets may be suppressed from spreading, because the ventilation system 40 and the fans 81, 82 perform the continuous operations. In this case, the fan 82 suctions air in the front chamber 220 through an undercut of the hinged door 225. In the continuous operation of the fan 82, an airflow amount per unit time exhausted from the inside of the toilet room 240 to the outside is supposed to be V2. Note that definitions of V1 and V3 are as previously described. Also in this case, V1, V2, and V3 satisfy the formulae (1) and (2).

DESCRIPTION OF REFERENCE CHARACTERS

10 house
120 entrance
150 changing room
160 wash and dressing room
170 bathroom
180, 210 corridor (passage)
1100 habitable room (third habitable room)
1101 doorway
1102 doorway (third doorway)
1103 sliding door
1104 sliding door (third door)
260 stairs (passage)
220 front chamber
224 hinged door (first door)
230 habitable room (first habitable room)
250 habitable room (second habitable room)
251 doorway (second doorway)
252 sliding door (second door)
30 ventilation system (second ventilation system)
40 ventilation system (first ventilation system)
310 new air suction port
320 air supply port
330 exhaust air suction port
340 air exhaust port
350 heat exchange unit
51, 52 air cleaner
61 fan (second fan)
81 fan (first fan)

The invention claimed is:

1. A house comprising:

a passage along an exterior wall and a first inner wall;

a front chamber defined by a first portion of the first inner wall and a second inner wall, the first inner wall having a first doorway immediately connecting the front chamber to the passage;

a toilet room defined by a first portion of the second inner wall and a third inner wall, the first portion of the second inner wall having a second doorway immediately connecting the toilet room to the front chamber;

a first habitable room defined by a second portion of the second inner wall and a third inner wall, the second portion of the second inner wall having a first habitable room doorway immediately connecting the first habitable room to the front chamber, the toilet room located on one side of the third inner wall and the first habitable room located at an opposite side of the third inner wall;

a first door configured to open and close the first habitable room doorway;

a first ventilation system configured to supply air from an outside of the house to the first habitable room and to exhaust air from the front chamber to the outside of the house;

a first fan configured to exhaust air from the first habitable room to the outside of the house; and a second fan configured to exhaust air from the toilet room to the outside of the house; and wherein the front chamber is defined by a plurality of inner walls including the first portion of the first inner wall and a second inner wall, and in which all doorways in the front chamber consist of the first doorway, the second doorway, and the first habitable room doorway.

2. The house according to claim 1, comprising:

a second habitable room laid out on a same floor as the front chamber and having a second habitable room doorway leading to the passage; and a second door configured to open and close the second habitable room doorway, wherein the first ventilation system is configured to further supply air from the outside of the house to the second habitable room.

3. The house according to claim 2, wherein the first ventilation system is configured to perform total heat exchange between new air taken from the outside of the house and exhaust air taken from the front chamber, and to supply the new air after the total heat exchange to the first habitable room and the second habitable room.

4. The house according to claim 3, comprising:

a wash and dressing room leading to the passage; and a bathroom leading to the wash and dressing room.

5. The house according to claim 2, comprising:

a wash and dressing room leading to the passage; and a bathroom leading to the wash and dressing room.

6. The house according to claim 5, further comprising:

an entrance; and a changing room leading to the entrance and the wash and dressing room, the changing room having storage furniture for clothes installed.

7. The house according to claim 6, comprising:

a third habitable room having a third habitable room doorway leading to the passage and laid out on a same floor as the wash and dressing room;

a third door configured to open and close the third habitable room doorway; and a second ventilation system configured to supply air from the outside of the house to the third habitable room and to exhaust air from the changing room to the outside of the house.

8. The house according to claim 7, wherein the second ventilation system is configured to perform total heat exchange between new air taken from the outside of the house and exhaust air taken from the changing room, and to supply the new air after the total heat exchange to the third habitable room.

9. The house according to claim 8, comprising an air cleaner installed in the third habitable room and configured to control an airflow amount in accordance with a number of people in the third habitable room.

10. The house according to claim 7, comprising an air cleaner installed in the third habitable room and configured to control an airflow amount in accordance with a number of people in the third habitable room.

11. The house according to claim 6, comprising:

a third habitable room having a third habitable room doorway leading to the passage and laid out on a same floor as the wash and dressing room;

a third door configured to open and close the third habitable room doorway; and a third fan configured to exhaust air from the changing room to the outside of the house.

12. The house according to claim 11, comprising an air cleaner installed in the third habitable room and configured to control an airflow amount in accordance with a number of people in the third habitable room.

13. The house according to claim 1, comprising:

a wash and dressing room leading to the passage; and a bathroom leading to the wash and dressing room.

14. The house of claim 1, wherein the toilet room has only one doorway, namely the second doorway.

* * * * *